United States Patent [19]

Dombroski

[11] Patent Number: 4,807,295

[45] Date of Patent: Feb. 21, 1989

[54] LOUDSPEAKER

[75] Inventor: Earl L. Dombroski, Rio Rancho, N. Mex.

[73] Assignee: Dumbroski and Hanson Industrial Designs, Inc., Rio Rancho, N. Mex.

[21] Appl. No.: 86,595

[22] Filed: Aug. 18, 1987

[51] Int. Cl.[4] ..... H04R 9/04

[52] U.S. Cl. ..... 381/194; 381/199

[58] Field of Search ..... 381/155, 157, 163, 159, 381/182, 184, 185, 186, 188, 194, 195, 196, 197, 199, 200, 201, 202, 204, 205

[56] References Cited

U.S. PATENT DOCUMENTS

| | | | |
|---|---|---|---|
| 1,872,799 | 8/1932 | Pare | 381/204 |
| 3,201,529 | 8/1965 | Surh | 381/186 |
| 3,660,618 | 5/1972 | White | 179/115.5 R |

FOREIGN PATENT DOCUMENTS

| | | | |
|---|---|---|---|
| 61152200 | 12/1984 | Japan | 381/199 |

*Primary Examiner*—John W. Caldwell, Sr.
*Assistant Examiner*—Alvin Oberley
*Attorney, Agent, or Firm*—Daniel C. McKown

[57] ABSTRACT

A loudspeaker design that eliminates the close tolerance magnetic gap used in conventional loudspeakers and in which motion of the diaphragm is produced by the attraction and repulsion of the magnetic poles of a solenoid and a permanent magnet. In the preferred embodiment, the permanent magnet is affixed to the frame, and the solenoid fits loosely about it, the two being coaxial. Elimination of the magnetic gap relaxes the dimensional tolerances of the loudspeaker as well as the possibility that heating will cause the coil to expand to the point of interfering with the pole pieces. Also, the design of the present invention results in the driving portion of the magnetic field being spread over a relatively larger volume of space, and this reduces the production of motion-induced voltages in the windings of the drive coil and improves linearity.

14 Claims, 2 Drawing Sheets

FIG. 2 (PRIOR ART)
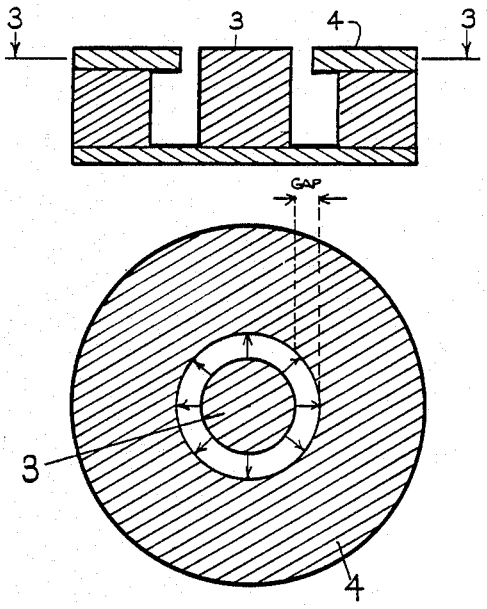
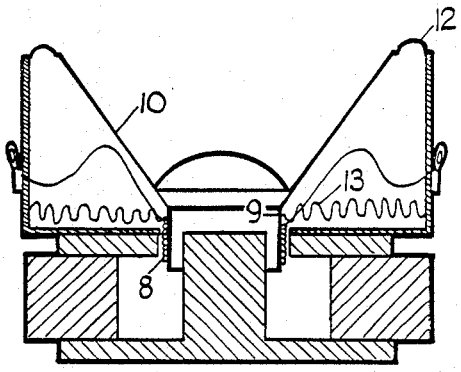
FIG. 1 (PRIOR ART)
FIG. 3 (PRIOR ART)
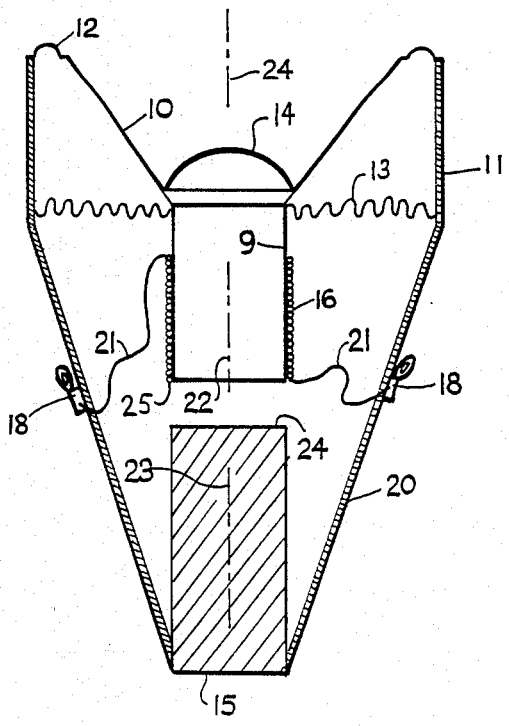
FIG. 4
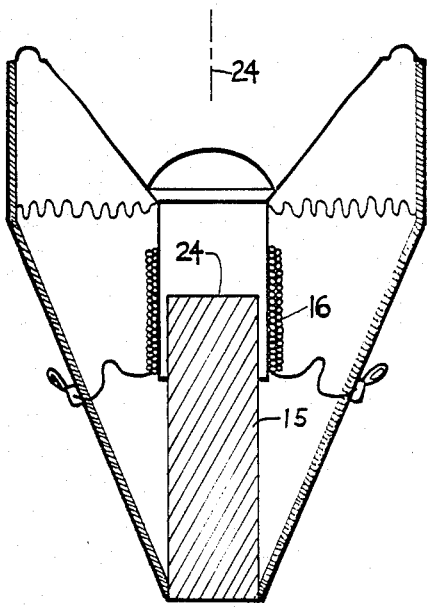
FIG. 5

FIG. 9
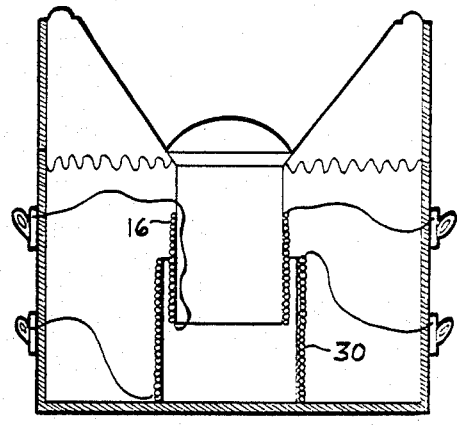
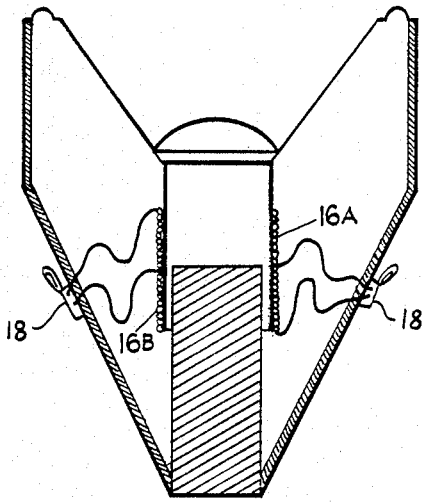
FIG. 6
FIG. 7
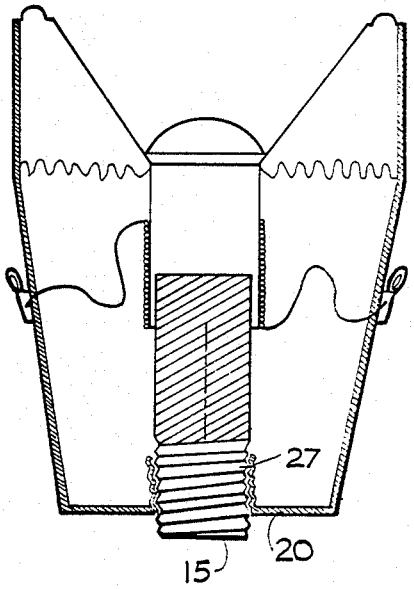
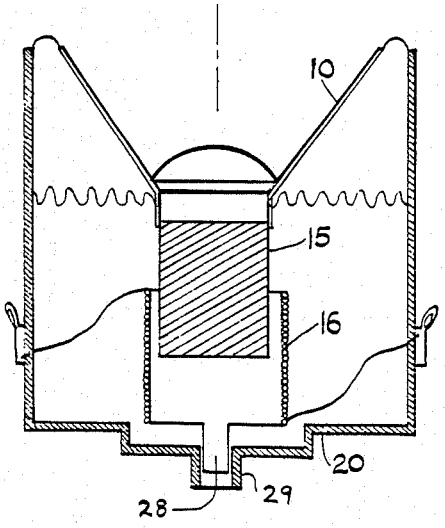
FIG. 8

LOUDSPEAKER

BACKGROUND OF THE INVENTION

1. Field of the Invention

The present invention is in the field of loud-speakers, and more specifically is concerned with a class of loudspeakers that exploits the advantages inherent in the use of solenoids having a length-to-diameter ratio that is considerably greater than in conventional voice coils.

2. The Prior Art

By far, the most common loudspeaker in use today is the permanent magnet loudspeaker, an example of which is shown in FIGS. 1–3. In that type of loudspeaker, the voice coil 8 typically consists of a number of turns of very fine wire wound on a former 9. The length of the winding is usually only a small fraction of its diameter. The length-to-diameter ratio is typically in the range from 0.1 to 0.5.

In the typical prior art loudspeaker shown in FIGS. 1–3, the voice coil 8 fits into a gap between a first pole piece 3 and a second pole piece 4. The former 9 is supported by the diaphragm 10 and the spider 13 keeps the voice coil 8 centered within the gap. The diaphragm 10 is flexibly supported by a flexible membrane 12.

In the arrangement of FIGS. 1–3, the magnetic lines of flux extend radially outwardly from the pole piece 3.

The turns of wire that make up the voice coil 8 extend circumferentially around the gap between the pole pieces 3 and 4.

When a current flows through the voice coil 8, the windings experience a force acting perpendicular to both the flux lines and the direction of current flow, and therefore the force is in the axial direction. The sense of the force depends on the sense of the current flow through the coil 8.

Loudspeakers of the type shown in FIGS. 1–3 are typically designed to minimize the mass of the moving voice coil assembly, and this tends to result in the use of voice coils having relatively low length-to-diameter ratios.

Also, in order to maximize the density of the flux lines within the gap, and hence the strength of the magnetic field there, the axial extent of the gap is often relatively small.

Designers typically have been much concerned with maintaining a uniform magnetic field within the gap.

The design orientation of the prior art leads to several problems which limit the performance of prior art loudspeakers.

The smaller dimensions used in the gap necessitate very accurate positioning of the parts, which necessitates tighter manufacturing tolerances, and this results in higher rejection rates and greater manufacturing costs.

A second problem that results from the design orientation of the prior art is related to the close tolerances required. When relatively high currents are forced through the voice coil, the voice coil may experience ohmic heating to such a degree that it expands radially sufficiently to touch the outer pole face, thereby resulting in undesirable sound effects.

Yet another problem of the prior art approach is that the use of a very strong magnetic field in the gap results in comparatively high motion-induced voltages in the voice coil. According to Lenz's Law this motion-induced voltage is in such a direction as to oppose the motion of the voice coil. Motion-induced voltages are undesirable because they complicate amplifier design.

SUMMARY OF THE INVENTION

The present invention embodies a new design approach which has significant advantages over the design orientation of the prior art for certain applications.

In contrast to the prior art approach, with its small dimensions, strong magnetic fields, and precision tolerances, the design approach of the present invention utilizes much longer solenoids, relatively weaker magnetic fields, and a welcome relaxation of tolerances.

In contrast with a loop, or with a solenoid whose length is considerably less than its diameter, an elongated solenoid produces a field within itself that is relatively constant over large axial distances. In a solenoid of infinite length, the magnetic field along the axis is constant. The natural tendency of the magnetic field within a solenoid to be constant has important implications for loudspeaker design.

Because the magnetic field within a solenoid of extended length varies little in the axial direction, large amplitudes of motion can be accommodated with little loss of linearity. Thus, instead of relying on a gap of small dimensions and high magnetic field, the design approach of the present invention employs a weaker magnetic field that is substantially constant over larger dimensions. This, in turn, eliminates the need for tight dimensional tolerances, thereby taking the loudspeaker out of the precision instrument category.

In accordance with the present invention, the voice coil is a solenoid having a length-to-diameter ratio greater than unity.

In accordance with the present invention, the solenoid is not confined radially within a gap, but instead, in most embodiments surrounds a permanent magnet. Therefore, in the present invention, expansion of the voice coil due to heating cannot cause mechanical interference.

Because the present invention uses a weaker magnetic field than is used in the approach of the prior art, motion-induced voltages in the coil are considerably reduced.

These, and other advantages of the present invention will become apparent as a number of embodiments of the present invention are discussed below in connection with the drawings. However, it is to be remembered that the drawings are by way of illustration only and do not limit the scope of the invention.

BRIEF DESCRIPTION OF THE DRAWINGS

FIG. 1 is a diagram showing a side elevational cross sectional view of a loudspeaker of the prior art;

FIG. 2 is a diagram showing a side elevational cross sectional view of the magnet assembly used in the loudspeaker of the prior art shown in FIG. 1;

FIG. 3 is a diagram showing a cross sectional view of the prior art magnet assembly of FIG. 2 in the direction 3—3 indicated in FIG. 2;

FIG. 4 is a diagram showing a side elevational cross sectional view of a loudspeaker in a first embodiment of the present invention;

FIG. 5 is a diagram showing a side elevational cross sectional view of a loudspeaker in a second embodiment of the present invention;

FIG. 6 is a diagram showing a side elevational cross sectional view of a loudspeaker in a third embodiment.

FIG. 7 is a diagram showing a side elevational cross sectional view of a loudspeaker in a fourth embodiment of the present invention;

FIG. 8 is a diagram showing a side elevational cross sectional view of a loudspeaker in a fifth embodiment of the present invention; and, FIG. 9 is a diagram showing a side elevational cross sectional view of a loudspeaker in a sixth embodiment of the present invention.

DETAILED DESCRIPTION OF THE PREFERRED EMBODIMENT

Turning now to the drawings in which like parts are designated by the same reference numeral throughout, it is noted that FIGS. 4–9 show six different embodiments of the present invention. A brief glance at those figures shows that the radial gap employed in the prior art shown in FIGS. 1–3 has been eliminated, and in all embodiments (except for FIG. 4) a solenoid having a length-to-diameter ratio greater than one fits loosely about a permanent magnet and is mounted for unopposed axial motion over a distance that is large compared to the amplitude permitted in prior art designs.

In the prior art loudspeaker of FIGS. 1–3, the magnetic field extends radially and is always perpendicular to the direction of current flow in the coil 8. Accordingly, the action of the current in producing motion of the coil 8 is usually explained by reference to the well-known Right Hand Rule.

In contrast, in the present invention, the magnetic lines of force have axial components as well as radial components and have quite a different shape from the magnetic field produced by the permanent magnets in the loudspeaker of the prior art. Accordingly, the operation of the present invention is better understood by use of the concept of magnetic poles.

For example, in the embodiment of the present invention shown in FIG. 4, the solenoid 16 may be thought of as having a magnetic pole located at each of its ends. The permanent magnet 15 also may be thought of as having a magnet pole at each of its ends. The polarity of the magnetic poles of the solenoid 16 depends on the instantaneous direction of the current through the windings of the solenoid. The force exerted on the solenoid 16 by the permanent magnet 15 may then be calculated by finding the resultant of the forces caused by the interaction of four pairs of poles, each pair including a pole from the solenoid 16 and a pole from the magnet 15.

The embodiment of FIG. 4 includes a frame 20 that includes a cylindrical basket 11 in which the diaphragm 10 is mounted. The diaphragm 10 is attached to the edge of the basket 11 by a flexible membrane 12. A cylindrical former 9 is attached to the smaller end of the conical diaphragm 10, and serves to carry the solenoid 16. The spider 13 keeps the former 9 centered within the assembly, and further helps to support the diaphragm and former. A dust cover 14 is cemented to the diaphragm 10 to prevent dust from entering the body of the loudspeaker. Flexible lead wires 21 connect the solenoid 16 electrically to the terminals 18, which are mounted on the frame 20.

The technique of mounting the diaphragm, and the structure of the diaphragm, the flexible membrane 12, the spider 13 and the dust cover 14 are well known in the prior art. However, the structure of the embodiment of FIG. 4 permits the frame 20 to be smaller in diameter at its rear end.

In the preferred embodiment of the invention shown in FIG. 4, the permanent magnet 15 has a cylindrical shape and a central axis 23. Likewise, in the preferred embodiment, the solenoid 16 has an axis 22. In the preferred embodiment, the axis 22 is colinear with the axis 23. Also, in the preferred embodiment, the diaphragm 10 is conical in shape, and has a central axis 24. In the preferred embodiment, the axis 24 is colinear with the axes 22 and 23.

In the embodiment of FIG. 4, there is a space in the axial direction between the end 24 of the permanent magnet and the end 25 of the solenoid 16.

The embodiment of FIG. 5 is generally the same as that of FIG. 4 with the exception that the end 24 of the permanent magnet 15 has been positioned within the solenoid 16. As in FIG. 4, because the magnetic field produced by the solenoid 16 diminishes with increasing distance from the solenoid, it follows that most of the force exerted on the solenoid, when it is energized, results from the pole of the permanent magnet that is located at the end 24.

Because the permanent magnet extends into the solenoid 16 in the embodiment of FIG. 5, the length of the loudspeaker in the axial direction is less than in FIG. 4.

The embodiment of FIG. 6 differs from that of FIG. 5 only in that the solenoid consists of two electrically separate but adjoining solenoids 16A and 16B, on the former 9. The solenoids 16A and 16B are connected in parallel electrically. Therefore, the resistance and the inductance measured across the terminals 18 are both reduced compared to what they would be if the windings 16A and 16B were connected in series as in FIG. 5. The reduced inductance and resistance enhance the response of the loudspeaker at higher frequencies.

The embodiment of FIG. 7 is similar to that of FIG. 5 with the exception that the permanent magnet 16, which is cylindrical in form, is adjustable axially with respect to the frame 20. In this embodiment, adjustment is made possible by providing threads 27 at one end of the permanent magnet 15, which threads engage corresponding threads on the frame 20.

The embodiment of FIG. 8 illustrates the point that in the embodiments of FIGS. 4–7, the solenoid can be replaced by a permanent magnet, and the permanent magnet can be replaced by a solenoid. In the embodiment of FIG. 8, a permanent magnet 15 is attached to the diaphragm 10 and moves axially with the diaphragm 10. The solenoid 16 is wound on the former 9 of paramagnetic material, such as plastic, and includes a pin 28 that projects from one end of the solenoid. The pin 28 is slidably retained by the collar 29, and the axial position can be set by bonding the pin to the collar.

The embodiment of FIG. 9 makes use of two solenoids 16, 30 rather than a solenoid and a permanent magnet.

Thus, there have been described several embodiments of a permanent magnet loudspeaker, notable for its elimination of the close tolerance magnetic gap used in the prior art and for using solenoids having length-to-diameter ratios greater than unity. The relatively greater length of the solenoid used in the present invention provides a magnetic field that is nearly uniform over a much larger volume of space than was the case in the loudspeakers of the prior art. This use of the solenoids improves the linearity of the speaker and eliminates critical manufacturing tolerances found in loudspeakers of the prior art. The absence of a closely-spaced gap avoids the possibility that, upon heating, the solenoid might expand and cause mechanical interference. Also, because the flux densities used in the present invention are considerably less than those used in the prior art, motion-induced voltages in the solenoid are appreciably reduced.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A loudspeaker comprising in combination:

a frame defining an aperture;

a diaphragm having an axis;

means for movably mounting said diaphragm to said frame so as to span the aperture, for limited motion along the axis;

a permanent magnet, but not more than one permanent magnet, cylindrical in shape and having an axis and two ends, attached to said frame with its axis substantially colinear with the axis of said diaphragm; and, a solenoid, attached to said diaphragm and having an axis substantially colinear to the axis of said permanent magnet, the length of said solenoid being greater than its diameter.

2. The loudspeaker of claim 1 wherein one end of said permanent magnet extends into said solenoid.

3. The loudspeaker of claim 1 wherein said solenoid further includes more than one winding electrically connected in parallel.

4. The loudspeaker of claim 1 further comprising means connected to said frame and to said permanent magnet for setting the position of said permanent magnet in the direction of the axis of said solenoid.

5. A loudspeaker comprising in combination:

a frame defining an aperture;

a diaphragm having an axis;

means for movably mounting said diaphragm to said frame so as to span the aperture, for limited motion along the axis;

a solenoid attached to said frame with its axis substantially colinear to the axis of said diaphragm, the length of said solenoid being greater than its diameter; and, a permanent magnet, but not more than one permanent magnet, cylindrical in shape and having an axis and two ends, attached to said diaphragm with its axis substantially colinear to the axis of the diaphragm.

6. The loudspeaker of claim 5 wherein one end of said permanent magnet extends into said solenoid.

7. The loudspeaker of claim 5 wherein said solenoid further includes more than one winding electrically connected in parallel.

8. The loudspeaker of claim 5 further comprising means connected to said frame and to said solenoid for setting the position of said solenoid in the direction of the axis of said diaphragm.

9. A loudspeaker comprising in combination:

a frame defining an aperture;

a diaphragm having an axis;

means for movably mounting said diaphragm to said frame so as to span the aperture, for limited motion along the axis;

a first solenoid attached to said frame with its axis substantially colinear to the axis of said diaphragm, the length of said solenoid being greater than its diameter; and, a second solenoid, attached to said diaphragm and having an axis substantially colinear to the axis of said first solenoid.

10. The loudspeaker of claim 9 wherein one end of said second solenoid extends into said first solenoid.

11. The loudspeaker of claim 9 wherein on end of said first solenoid extends into said second solenoid.

12. The loudspeaker of claim 9 wherein said first solenoid further includes more than one winding electrically connected in parallel.

13. The loudspeaker of claim 9 wherein said second solenoid further includes more than one winding electrically connected in parallel.

14. The loudspeaker of claim 9 further comprising means connected to said frame and to said first solenoid for setting the position of said first solenoid in the direction of the axis of said diaphragm.

* * * * *